United States Patent [19]

Fell

[11] Patent Number: 5,058,637

[45] Date of Patent: Oct. 22, 1991

[54] MESSAGE DISPLAY SADDLE FOR FUEL DISPENSING NOZZLE

[75] Inventor: Michael J. Fell, Bryn Mawr, Pa.

[73] Assignee: M&M Displays, Inc., Philadelphia, Pa.

[21] Appl. No.: 511,866

[22] Filed: Apr. 26, 1990

Related U.S. Application Data

[63] Continuation-in-part of Ser. No. 397,774, Aug. 23, 1989, abandoned.

[51] Int. Cl.[5] ..... B67D 5/00

[52] U.S. Cl. ..... 141/392; 141/98; 40/661; 222/23

[58] Field of Search ..... 141/1, 98, 390, 392; 40/299, 311, 658, 661; 222/23

[56] References Cited

U.S. PATENT DOCUMENTS

| | | | |
|---|---|---|---|
| 1,350,275 | 8/1920 | Gafinowitz | 40/661 X |
| 1,636,500 | 7/1927 | Cox | 40/661 |
| 1,729,961 | 11/1927 | Partridge | 40/661 X |
| 2,283,479 | 11/1955 | Zdanowski . | |
| 2,295,468 | 1/1940 | Haley | 40/661 X |
| 2,800,931 | 7/1957 | Sutcliffe | 141/392 |
| 3,337,976 | 12/1964 | Winger . | |
| 3,474,837 | 10/1969 | Carder et al. | 141/392 |
| 4,010,781 | 3/1977 | Sutcliffe | 141/392 |
| 4,073,612 | 2/1978 | Nitta | 431/126 |
| 4,268,986 | 5/1981 | Paina | 40/316 |
| 4,275,518 | 6/1981 | Martin | 40/661 X |
| 4,453,325 | 6/1984 | Ofsowitz et al. | 40/333 |
| 4,465,209 | 8/1984 | Wilder | 222/23 |
| 4,545,140 | 10/1985 | Winston | 40/661 |
| 4,593,729 | 6/1986 | Tamra | 141/392 X |

FOREIGN PATENT DOCUMENTS

| | | | |
|---|---|---|---|
| 980890 | 1/1965 | United Kingdom | 141/392 |

*Primary Examiner*—Ernest G. Cusick

*Attorney, Agent, or Firm*—Frank J. Benasutti

[57] ABSTRACT

A message display boot is provided for a fuel dispensing nozzle. The display boot comprises a flexible plastic boot in close conforming fit over at least the front valve housing of the nozzle. At the top of the boot in a message platform upon which rests a message placard. The placard is removable held on the platform by an optically clear skirted cover conforming to the contour of the platform, such that the cover is held on the platform by the close conforming fit of the skirt along the sides of the platform, but can be easily pried off the platform to change the placard. A bellow portion at the bottom of the boot provides a conforming fit over nozzles of various height. A resilient bumper shields the message platform and cover from contact with the vehicle. In a preferred embodiment, the boot, platform, bellows and bumper are integrally molded of plastisol vinyl.

12 Claims, 3 Drawing Sheets

MESSAGE DISPLAY SADDLE FOR FUEL DISPENSING NOZZLE

This application is a continuation-in-part of Ser. No. 07/397,774 filed Aug. 23, 1989 and abandoned upon the filing of this application.

BACKGROUND OF INVENTION

This invention relates to advertising message display devices. More particularly, it relates to a message display boot to be used on a fuel dispensing nozzle. The display boot permits the advertising message to be periodically changed, and locates it at a visually prominent position to the self-service customer, while he is dispensing his own fuel, without interfering with or encumbering his operation of the fuel dispensing nozzle. It can also be used to display messages to the employee operator at full service or mini service stations.

In the prior art devices, it was known to attach a message display to the top a fuel dispensing nozzle. With the recent proliferation of self-service stations, it is now common for drivers to pump fuel into their own vehicles. In so doing, the customer's visual attention is necessarily focused directly on the fuel nozzle itself, making the top of the fuel nozzle a desirable site for an advertising message, since the customer is compeled to notice and read the message as he dispenses his fuel. However, such prior art message displays are cumbersome, visually unattractive, and easily damaged devices in that they are affixed to the fuel nozzle by harness straps, connected by Velcro or snap connectors. The present invention overcomes the disadvantage of these prior devices by providing a close-fitting vinyl boot with the message display platform mounted directly thereon, either by integral molding with the boot itself or by an appropriate retainer means to the boot such as rivets, snaps or adhesive bonding. Consequently, the message display device of the present invention is non-obstructive, appears to be a part of the nozzle itself, and is difficult to damage or remove from the nozzle.

These and other advantages of the present invention will be readily apparent in the detailed description and drawings which follow.

OBJECTS OF THE INVENTION

A principal object of the invention is to provide a message display for a fuel dispensing nozzle in which the message display is contained on a flexible boot closely conforming to the contour of the fuel nozzle itself.

Another object of the invention is to provide a message display platform which is securely mounted on the boot, either by integral molding with the boot or by appropriate permanent fastening to the boot, such that the message display platform will not be an obstruction to dispensing fuel, and will not be easily damaged or dislodged from the fuel nozzle.

Another object is to provide message display platforms of a variety of shapes such that an individual platform shape may be a replica of the logo of a fuel refiner or a fuel retailer.

Another object of the invention is to provide means to periodically change the displayed message with relative ease and without the necessity of removing the display boot from the nozzle.

Another object of the invention is to provide a protective bumper guard between the display platform and the body of the vehicle so that the display is not damaged during the fuel dispensing operation.

Other objects and advantages of the invention will become apparent upon reading the specifications and drawings.

SUMMARY OF THE INVENTION

A message display boot is provided for a fuel dispersing nozzle. The boot comprises a flexible plastic boot in close conforming fit over at least the front valve housing of the nozzle. At the top of the boot is mounted a message display platform upon which rests a message placard. The placard is removably held on the platform by an optically clear skirted cover conforming to the contour of the platform, such that it is held on the platform by the close conforming fit of the skirt along the sides of the platform, but can be easily pried off the platform to change the placard. A bellows portion at the bottom of the boot provides a conforming fit over nozzles of various height. A resilient bumper shields the message platform and cover from contact with the vehicle. In a preferred embodiment, the boot, platform, bellows and bumper are integrally molded of plasicized vinyl.

DETAILED DESCRIPTION

Figure 1:
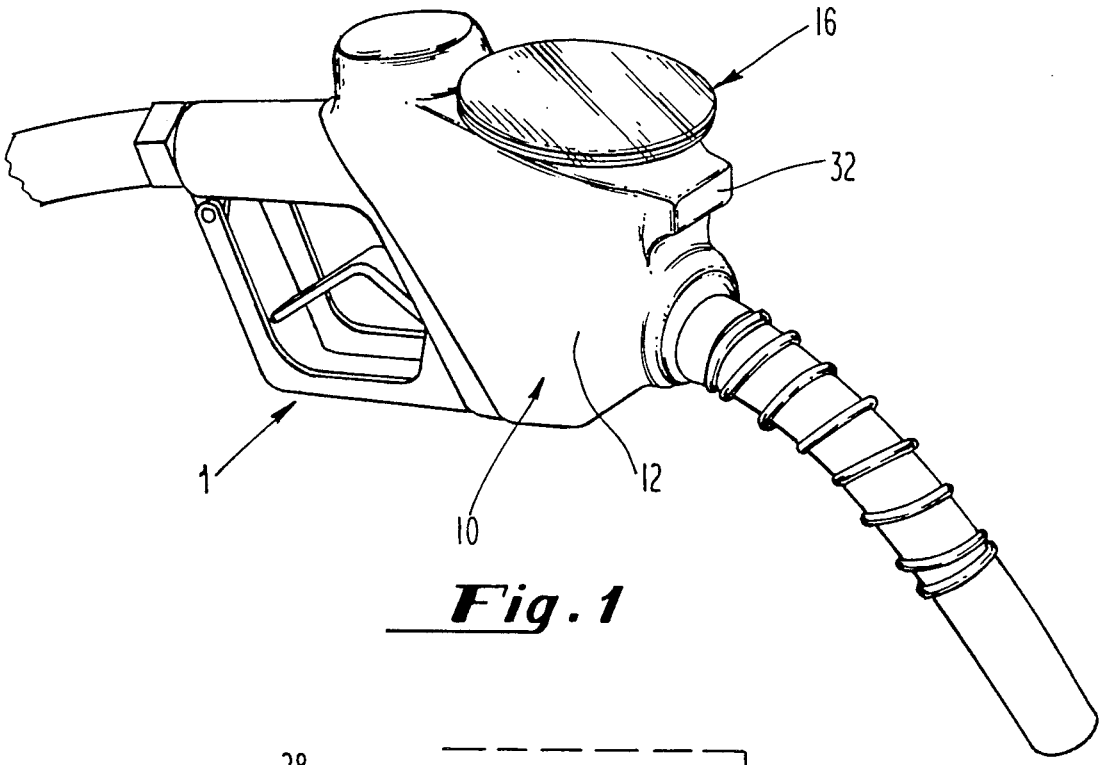
FIG. 1 is a perspective view of a typical fuel dispensing nozzle having mounted thereon a message display boot according to the present invention.

Referring to FIG. 1, there is shown a typical fuel dispensing nozzle 1, as is commonly found at service stations for dispensing gasoline, kerosene, diesel and other fuels. Mounted on the nozzle 1 is a message display boot 10 according to the present invention. As can be seen from FIG. 1, the message display boot 10 fits in close conformity over the front portion of the nozzle where the nozzle it valves are housed, and as such, appears to be part of the nozzle itself. This boot is easily installed over the nozzle, and because of the close conforming fit, is prevented from sliding around or becoming a cumbersome obstacle in dispensing the fuel. The boot further places the message directly on top of the nozzle at the point where the operator's visual attention will be focused during nozzle insertion and operation.

Figure 2:
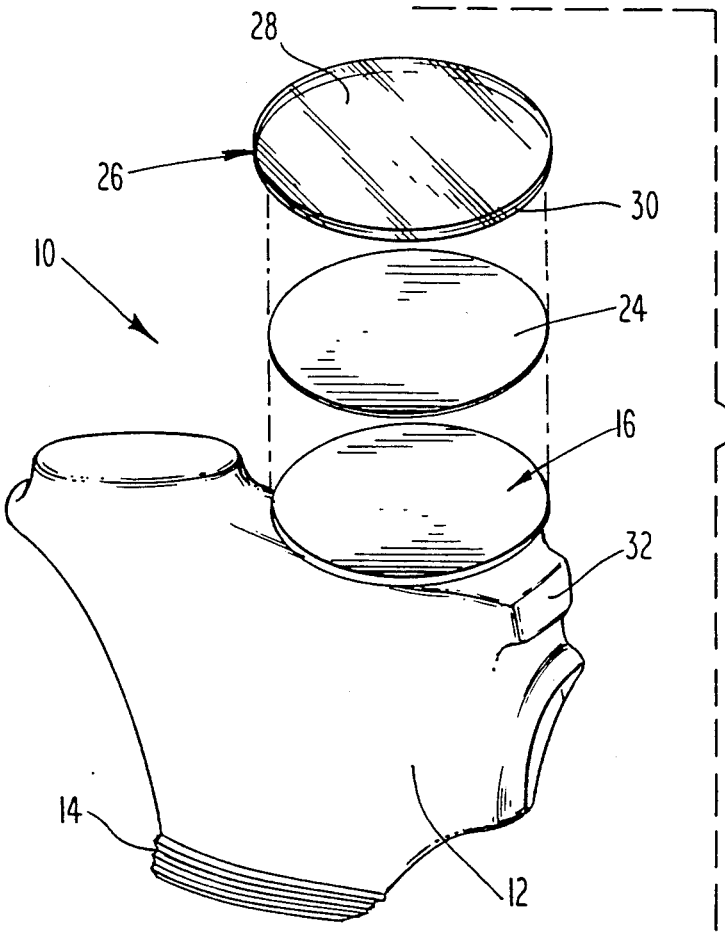
FIG. 2 is a perspective and exploded view of a basic embodiment of a message dispensing boot according to the present invention.
Figure 3:
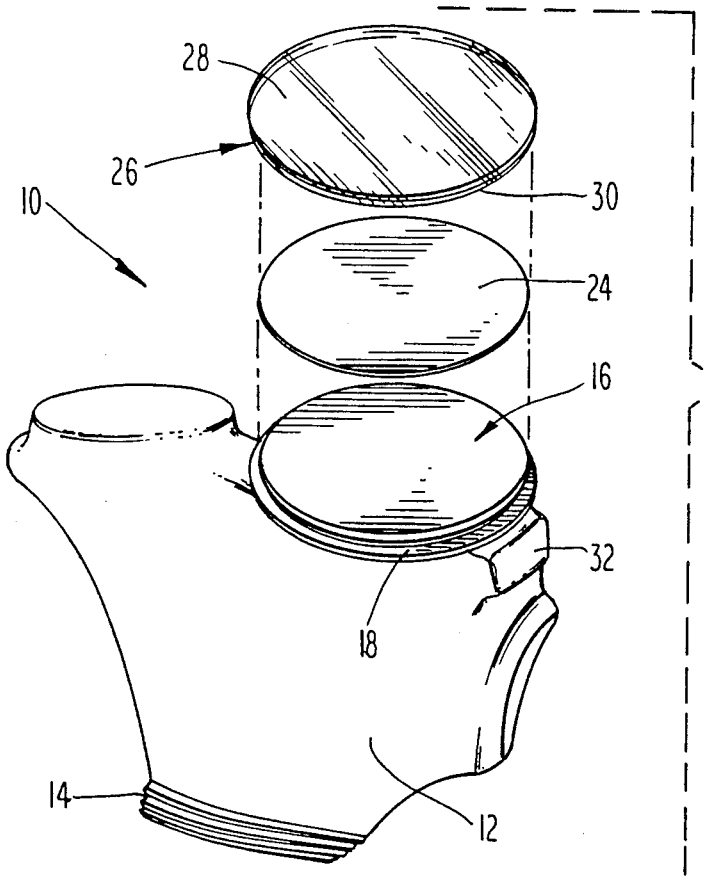
FIG. 3 is a perspective and exploded view of an alternative embodiment boot according to the present invention, having a platform with a protective lip.
Figure 4:
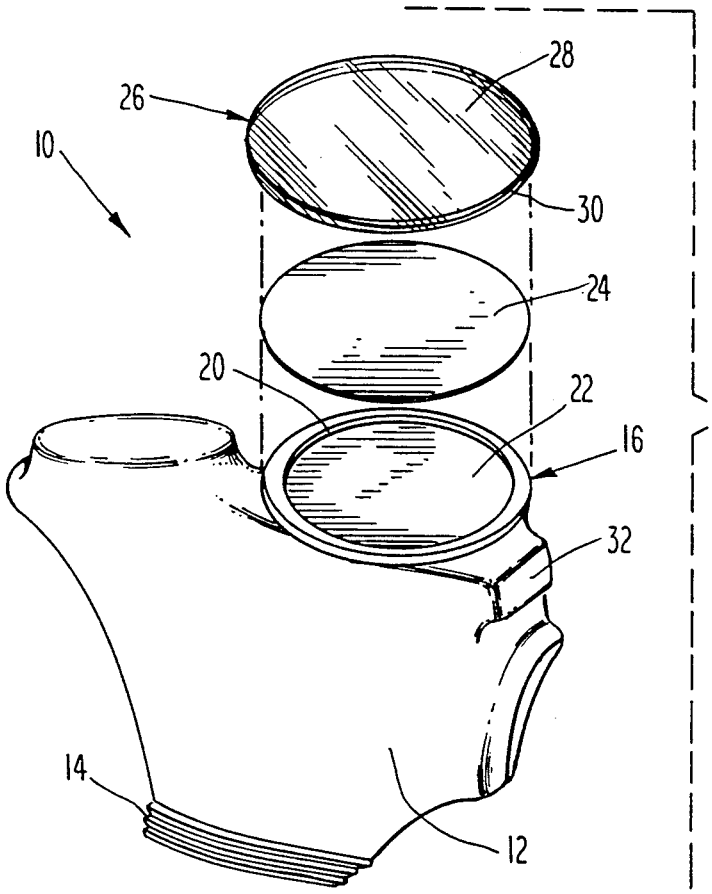
FIG. 4 is a perspective and exploded view of another alternative embodiment boot according to the present invention, having a permanent message encased in the message platform, wherein the changeable message placard overlies the permanent message.

Details of the boot are shown more particularly in the embodiments of FIGS. 2, 3 and 4. The display boot 10 comprises a boot portion 12, which is preferably constructed of a flexible material such as a plasticized vinyl. The boot portion 12 conforms closely to the contour of the front portion of the nozzle ahead of its handle and operating lever, and is preferably of unitary construction, wherein it is pulled onto the nozzle over its insertion end. However, the boot 12 could be constructed so that the bottom portion forms two separate flaps which are joined by snap fasteners. Further, the boot portion 12 may be extended back over the handle of the nozzle if the nozzle does not already have a rubber or plastic leak guard, or where the original leak guard needs replacement.

The bottom of the boot portion 12 further comprises a bellows portion 14 to accommodate the differences in height of various nozzles. The boot portion 12 is dimensioned to conform to nozzles of the smallest height with the bellows 14 relaxed, allowing the accordion folds of the bellows 14 to expand to provide a close-conforming fit over nozzles having a greater height.

Located at the top of the boot portion 12 is the message display platform 16. The message display platform 16 is preferably molded integrally with the boot portion 12, or alternatively may be affixed to the boot portion 12 by any appropriate fastening means, such as rivets or adhesive bond. The message platform 16 may be of a variety of shapes, such that a particular shape may replicate the outline of the logo of a fuel refiner or retailer, such as, for example, the MOBIL, CHEVRON, SHELL, or 7-11 logos. This is a particularly desirable feature in that the affiliation of the service station to a particular refiner or retailer chain is made and reinforced simultaneously with the text of the message. The platform 16 will preferably be molded around an appropriately shaped metallic plate to provide it with rigidity.

As shown in FIG. 3, the message plato, 16 may have a protective rim 18 surrounding it. The protective rim 18 will absorb impact to the side of the message display platform 16, keeping the message and its cover from being damaged or dislodged.

As shown in FIG. 4, the message display platform 16 may further include a recessed lip 20, into which may be inserted a permanent message disk 22. The permanent message disk 22 may preferably be an aluminum disk which is set into the recessed lip 20 after molding while the hot vinyl is soft, and thereby be tightly affixed after cooling. The permanent message disk 22 may display information of a continuing nature, such as an identification of the retailer, the pump operating instructions or other information which does not relate to periodic promotions or temporary conditions.

A changeable message placard 24, preferably of paperboard, styrene, or vinyl, having the same shape as the platform 16, rests upon the platform 16. The message placard 24 will typically advertise periodic promotional messages, such as free or discounted merchandise with a certain volume fuel purchase, other services provided by the retailer, or other temporary information, such as an "OUT-OF-ORDER" message when the pump is empty or inoperative.

Overlying the message placard 24 and making a sealing attachment to the platform 16 is a removable message cover 26. The cover 26 has an optically clear top surface 28 so that the message can be seen, and a retainer skirt 30 to fit closely along the sides of the platform 16. The skirt may also the of the same optically clear material as the top surface 28, although it is not necessary that it be so. The cover 26 may be vacuum formed or injection molded of an appropriate material, such as clear polyvinylchloride. When the message platform is constructed of a vinyl with plasticizer additive, the plasticizer additive provides a tacky surface which adheres to the polyvinylchloride cover, helping to hold the cover on the platform and reduce moisture from leaking under the cover. The closely fitting skirt 30 retains the cover 26 over the platform 16, but it can be pried off to allow the message placard 24 to be changed.

Alternatively, the message placard 24 may be attached to either the inner side or outer side of the cover's top surface 28 by adhesive substance. In such embodiment, a new cover 26 and message placard 24 combination must be used for each message change.

A bumper 32 is provided at the front of the boot portion 12 and extends beyond the message display platform 16, to contact the vehicle when the nozzle is inserted into the filler pipe. The bumper 32 is preferably an integrally molded hollow protrusion of the boot portion 12 generally rectangular in shape, to provide a resilient bumper that will protect the message display but not mar the vehicle.

Figure 5:
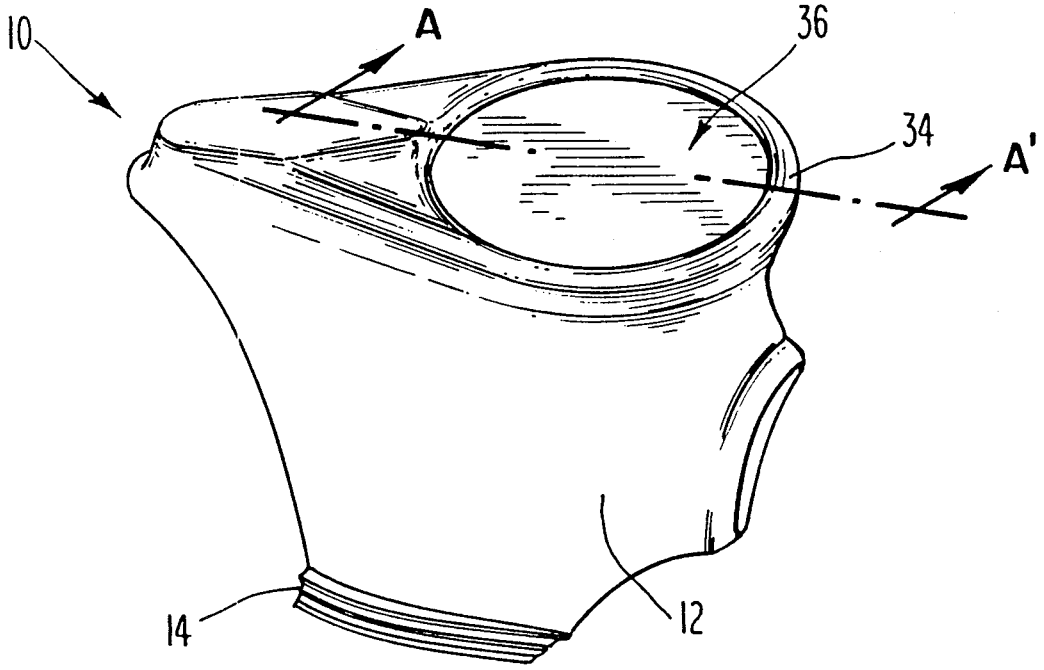
FIG. 5 is a perspective view of an alternative embodiment boot according to the invention.
Figure 6:
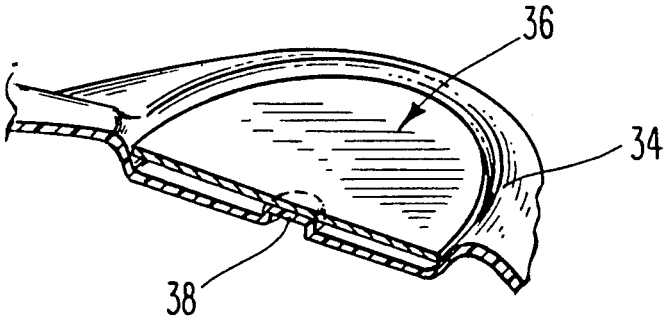
FIG. 6 is a partial section view along the line A—A' of FIG. 5.

A presently preferred embodiment is depicted in FIG. 5. The boot 10 has an integral raised resilient bumper 34, which surrounds the message display platform near or above the platform height, to reduce the possibility of the message cover being dislodged or damaged by impact from any side. The bumper 34 replaces the front bumper 32 of the previously described embodiments and the protective rim 18 of the embodiment shown in FIG. 3. In this embodiment, the display platform is an aluminum disc 36 mounted on a pedestal 38 of the boot, as depicted in FIG. 6. The pedestal 38 is molded into the boot 12 to raise the disc 36 from the cover sufficiently to accommodate the cover 26. The disc 36 is heat attached to the pedestal 38. The disc 36 has a diameter slightly smaller than the inside diameter of the bumper 34 to allow a skirted cover as described in the previous embodiments to fit over the sides of the disc 36.

As can easily be visualized, the display boot 10 can be easily installed on a fuel pump nozzle by pulling it on over the insertion end of the nozzle, and once installed appears to be part of the nozzle itself, much as a second leak guard. In fact, it will perform as an additional leak guard over the area it covers.

By its close conforming fit, the display boot 10 keeps the advertising message in its proper location on the top of the nozzle, without being a cumbersome or visually unattractive device such as the prior art harnesses. When the nozzle is inserted into the vehicle's tank filler pipe, the resilient bumper 26 limits the insertion and protects the message display and the cover 26 from being impacted. By simply snapping of the cover 26 and replacing the message placard 24, the advertising message can be easily changed by the service station operator.

I claim:

1. A message display device for a fuel dispensing nozzle, comprising:

(a) a flexible boot adapted for close conforming fit over at least a front portion of the nozzle;

(b) a substantially flat message display platform mounted on a top surface of the boot with respect to the nozzle;

(c) a message placard resting upon the platform, and;

(d) an optically clear cover having a skirted edge depending in close conforming fit along the contour of the platform, such that the cover will hold the placard on the platform but may be pried away from the platform to allow the placard to be changed.

2. A message device as in claim 1, further comprising the boot having a bellows portion adapted to accommodate a close conforming fit over nozzles of various lengths.

3. A message display device as in claim 2, further comprising a resilient bumper, adapted to shield the platform.

4. A message display device as in claim 3, wherein the boot is made of molded plastic material and the message platform, bellows portion, message platform and bumper are integrally molded with the boot.

5. A message display device as in claim 1, further comprising a resilient bumper, adapted to shield the platform.

6. A message display device as in claim 5, wherein the boot is made of molded plastic material and the message platform and bumper are integrally molded with the boot.

7. A message display device as in claim 6, wherein the plastic material is a plastisol vinyl.

8. A message display device as in claim 5, wherein the resilient bumper substantially surrounds the circumference of the message platform.

9. A message display device as in claim 1, wherein the placard is affixed to the cover.

10. A message display device as in claim 1, wherein the message display platform has a protective rim extending circumferentially beyond the skirted edge of the cover.

11. A message display device as in claim 1, wherein the message display platform has a permanent message display disk on its top surface.

12. A fuel dispenser nozzle display sleeve for a fuel nozzle, wherein the nozzle includes a spout and handle, comprising:

(a) a sleeve, adapted to slidably engage the nozzle, having respective ends, one end to receive the spout, the other to receive the handle;

(b) a substantially flat display platform integral with the sleeve; and (c) a substantially clear cover having a periphery, wherein the periphery includes edge section extending substantially around the periphery to provide a close, conforming and interfering fit with the platform.

* * * * *